United States Patent [19]

Neimanns et al.

[11] 4,080,726

[45] Mar. 28, 1978

[54] METHOD FOR MANUFACTURING AN ELECTRICAL HEATING DEVICE

[75] Inventors: Nikolaus Neimanns, Salmunster; Manfred Krupka, Wachtersbach, both of Germany

[73] Assignee: Siemens Aktiengesellschaft, Berlin and Munich, Germany

[21] Appl. No.: 771,383

[22] Filed: Feb. 23, 1977

[51] Int. Cl.[2] ..... H01C 17/02; H01C 1/02

[52] U.S. Cl. ..... 29/611; 29/613; 219/548

[58] Field of Search ..... 29/611, 613; 219/548

[56] References Cited

FOREIGN PATENT DOCUMENTS

| | | | |
|---|---|---|---|
| 788,672 | 7/1968 | Canada | 29/611 |
| 1,028,398 | 5/1966 | United Kingdom | 29/611 |

*Primary Examiner*—Victor A. DiPalma

*Attorney, Agent, or Firm*—Kenyon & Kenyon, Reilly, Carr & Chapin

[57] ABSTRACT

An improved method for manufacturing an electrical heating device including the steps of placing an electric heating element comprising an electrical resistor, electrical insulation material, and a metallic jacket within a cladding tube, filling the remaining space in the cladding tube with a metal powder having a high thermal conductivity, densifying the powder after the powder is placed in the cladding tube, and subsequently sintering the powder. The improvement of the invention comprises the steps of mixing the metal powder, prior to the step of filling, from grain sizes which produce a high filling density in the cladding tube. The metal powder is then additionally densified, subsequent to the step of densifying previously carried out but prior to the step of sintering, by reducing the diameter of the cladding tube. The diameter of the cladding tube is then further reduced to compensate for shrinkage of the metal powder during the step of sintering.

8 Claims, 1 Drawing Figure

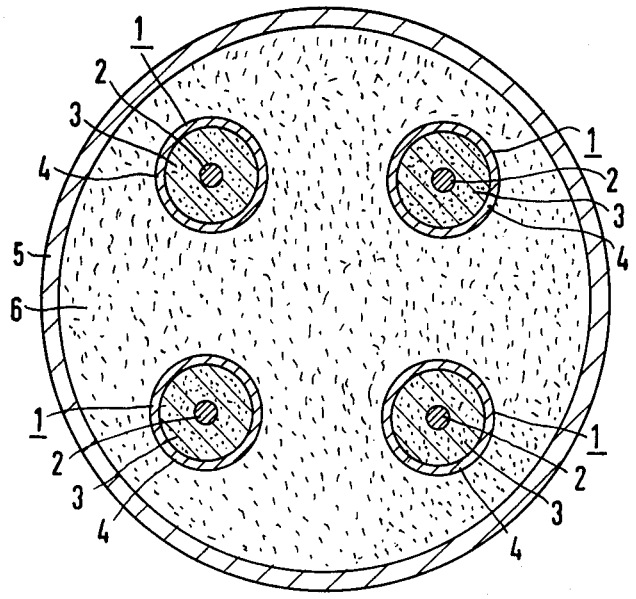
1
2
3
4
5
6
1
2
3
4
1
2
3
4
1
2
3
4

METHOD FOR MANUFACTURING AN ELECTRICAL HEATING DEVICE

BACKGROUND OF THE INVENTION

1. Field of the Invention

The present invention relates generally to electrical heating devices, and in particular to an improved method for manufacturing such heating devices.

2. Description of the Prior Art

Methods for manufacturing an electrical heating device by placing an electric heating element comprising an electrical resistor, electrical insulation material and a metallic jacket within a cladding tube, filling the remaining space in the cladding tube with a metal powder having a high thermal conductivity, densifying the powder by means of vibration after the powder is placed in the cladding tube, and subsequently sinering the powder by heating the heating element or by externally heating the heating device, are known in the art. See, for example, British patent specification No. 1,028,398.

SUMMARY OF THE INVENTION

It is an object of the present invention to provide an improved method for manufacturing an electrical heating device in which the load capacity of the heating element of the heating device is increased.

This and other objects are achieved in a method for manufacturing an electrical heating device including the steps of placing an electric heating element comprising an electrical resistor, electrical insultion material and a metallic jacket within a cladding tube, filling the remaining space in the cladding tube with a metal powder having a high thermal conductivity, densifying the powder after the powder is placed in the cladding tube, and subsequently sintering the powder. The improvement of the invention comprises the steps of mixing the metal powder, prior to the step of filling, from grain sizes which produces a high filling density in the cladding tube; additionally densifying the metal powder subsequent to the first step of densifying but prior to the step of sintering, by reducing the diameter of the cladding tube; and further reducing the diameter of the cladding tube to compensate for shrinkage of the metal powder during the step of sintering.

The advantage of the method of the invention is that as a result of the high ultimate density of the metal powder, which is achieved in a simple manner, the thermal flux between the heating element of the heating device and the cladding tube is improved with the result that the load capacity of the heating element is increased.

In the inventive method, the step of sintering may comprise sintering the metal powder by heating the heating element and/or externally heating the cladding tube. Also, the step of additionally densifying may comprise densifying the metal powder by reducing the diameter of the tube by swaging or rolling the cladding tube. The step of further reducing the diameter of the cladding tube may also comprise reducing the tube diameter by swaging or rolling the cladding tube.

These and other novel features and advantages of the invention will be described in greater detail in the following detailed description.

BRIEF DESCRIPTION OF THE DRAWING

The drawing is a cross-sectional, top elevational view of an electrical heating device constructed in accordance with the improved method of the present invention.

DETAILED DESCRIPTION

Referring now to the drawing, there is shown an electric heating element 1 consisting of an electrical resistor 2, electrical insulation material 3 disposed about resistor 2, and a metallic jacket 4 disposed about material 3 and resistor 2. The heating element is disposed in a cladding tube 5 and, in the embodiment of the invention shown, includes four leg portions. It should be noted that the number of heating element leg portions is arbitrary and that any number may be used. It also should be noted that the ends of heating element 1 may extend from one end of cladding tube 5 or, alternatively, the heating element may protrude from both ends of the cladding tube. In addition, one or more heating elements may be disposed within the cladding tube and, for example, a tubular heating element or a heater cable may be utilized as the heating element. In addition to the configuration shown, heating element 1 may also be disposed in cladding tube 5 in the form of the helix.

An electrical heating device such as that illustrated in the drawing is constructed according to the improved method of the invention in the following manner:

After heatng element 1 is disposed in cladding tube 5, the remaining space in cladding tube 5 is filled with a metal powder 6 having a high thermal conductivity. A suitable metal powder may comprise, for example, copper. The cladding tube is preferably vibrated during filling of the tube with the metal powder in order to obtain a high filling density. Before filling the cladding tube, however, the metal powder is first mixed from grain sizes which produce a high filling density kin cladding tube 5. For copper metal powder, a high filling density is produced in cladding tube 5 by mixing the powder from the following grain sizes and with the following distribution: 30% spheric grains in of a size from 10 MY to 45 MY, average 25 MY; 70% spheric grains of a size from 1 MY to 315 MY, average 200 MY (1 MY = appended 1/1,000 millimeter). After filling, the metal powder is additionally densified by swaging or rolling the cladding tube. The metal powder may also be densified by drawing or any other operation which reduces the diameter of the cladding tube and, accordingly, will densify metal powder 6 in the tube. The powder is then sintered to improve the thermal conductivity of the metal by heating heating element 1 and/or externally heating cladding tube 5. In order to compensate for shrinkage that may take place in the metal powder during sintering, cladding tube 5 is subsequently subjected to further diameter reduction by swaging or rolling.

In the foregoing specification, the invention has been described with reference to specific exemplary embodiments thereof. It will, however, be evident that various modifications and changes may be made thereunto without departing from the broader spirit and the scope of the invention as set forth in the appended claims. The specification and drawing is, accordingly, to be regarded in an illustrative rather than in a restrictive sense.

We claim:

1. In a method for manufacturing an electrical heating device including the steps of placing an electric heating element comprising an electrical resistor, electrical insulaton material and a metallic jacket within a cladding tube, filling the remaining space in the cladding tube with a metal powder having a high thermal conductivity, first densifying the powder after the powder is placed in the cladding tube, and subsequently sintering the powder, the improvement comprising the steps of mixing said metal powder, prior to said step of filling, from grain sizes which produce a high filling density in said cladding tube, additionally densifying said metal powder, subsequent to said step of first densifying but prior to said step of sintering, by reducing the diameter of said cladding tube, and further reducing the diameter of said cladding tube to compensate for shrinkage of said metal powder during said step of sinterng.

2. The method recited in claim 1, wherein said step of sintering comprises sintering said metal powder by heating said heating element.

3. The method recited in claim 1, wherein said step of sinterng comprises sintering said metal powder by externally heating said cladding tube.

4. The method recited in claim 3, wherein said step of sintering further comprises sintering said metal powder by heating said heating element.

5. A method recited in claim 1, wherein said step of additionally densifying comprises densifying said metal powder by reducing the diameter of said tube by swaging said tube.

6. The method recited in claim 1, wherein said step of additionally densifying comprises densifying said metal powder by reducing the diameter of said tube by rolling said tube.

7. The method recited in claim 1, wherein said step of further reducing comprises further reducing the diameter of said tube by swaging said tube.

8. The method recited in claim 1, wherein said step of further reducing comprises further reducing the diameter of said tube by rolling said tube.

* * * * *